US007000557B1

(12) United States Patent
Forbes et al.

(10) Patent No.: US 7,000,557 B1
(45) Date of Patent: Feb. 21, 2006

(54) HATCH ASSEMBLY WITH SEAT AND STORAGE BIN

(75) Inventors: Evan D. Forbes, Carterville, IL (US); Karlis Matvejs, Marion, IL (US); Kevin J. Riem, Marion, IL (US)

(73) Assignee: Crownline Boats, Inc., West Frankfort, IL (US)

( * ) Notice: Subject to any disclaimer, the term of this patent is extended or adjusted under 35 U.S.C. 154(b) by 0 days.

(21) Appl. No.: 11/028,807

(22) Filed: Jan. 4, 2005

Related U.S. Application Data

(60) Provisional application No. 60/607,181, filed on Sep. 3, 2004.

(51) Int. Cl.
*B63B 19/12* (2006.01)
*B63B 17/00* (2006.01)

(52) U.S. Cl. ..... 114/201 R; 114/363

(58) Field of Classification Search ..... 114/201 R, 114/363

See application file for complete search history.

(56) References Cited

U.S. PATENT DOCUMENTS 4,854,261 A * 8/1989 Goldsmith ..... 114/363
6,553,928 B1 * 4/2003 Yamada et al. ..... 114/55.51

* cited by examiner

*Primary Examiner*—Stephen Avila
(74) *Attorney, Agent, or Firm*—Polster, Lieder, Woodruff & Lucchesi L.C.

(57) ABSTRACT

A hatch assembly for a boat including a base pivotally attached to a boat deck, whereby the base can pivot between an open position and closed position to provide access to an power source within a boat hull. The base defines a storage bin with a compartment for storage. A lid pivotally attaches to the base, whereby the lid can pivot from an open position to a closed position to provide access to the storage bin. A seat attaches to the lid and is supported by the base. A backrest pivotally attaches to the base and pivots between a sitting position and a reclining position.

26 Claims, 8 Drawing Sheets

HATCH ASSEMBLY WITH SEAT AND STORAGE BIN

CROSS-REFERENCE TO RELATED APPLICATIONS

This application is related to U.S. Provisional Patent Application No. 60/607,181 filed Sep. 3, 2004 from which priority is claimed, and is hereby incorporated by reference.

STATEMENT REGARDING FEDERALLY SPONSORED RESEARCH

Not Applicable.

BACKGROUND OF THE INVENTION

This invention relates in general to boats and boat decks, and more particularly, to boat deck hatches. Most modern boats include numerous conveniences that make boating a pleasurable experience. Among these conveniences are flexible seating arrangements, large storage bins, and various accessories, such as tables. However, due to the limited space available on boats, including these conveniences can take away valuable deck space from other more necessary boat components, such as a boat hatch that allows access to an inboard motor. Therefore, it is important to configure all boating components, necessary and convenient, in a configuration that maximizes deck space.

SUMMARY OF THE INVENTION

Briefly stated, the invention is a boat having a deck with a hatch assembly with a seat and storage bin for use in a boat. The hatch assembly includes a base pivotally attached to a boat deck, whereby the base can pivot between an open position and closed position to provide access to the boat hull, and the base defines a storage bin. A lid pivotally attaches to the base, whereby the lid can pivot from an open position to a closed position to provide access to the storage bin. At least one seat attaches to the lid.

In another embodiment, a hatch assembly includes a storage means pivotally attached to a boat deck, whereby the storage means pivots between an open position and closed position to provide access to the boat hull. A seating means pivotally attaches to the storage means, whereby the seating means pivots from an open position to a closed position to provide access to the storage means.

In another embodiment, a hatch assembly includes a base removably attached to a boat deck, whereby the base can move between an open position and closed position to provide access to a boat hull, wherein the base defines a storage bin. A lid removably attaches to the base, whereby the lid can move between an open position and a closed position to provide access to the storage bin. At least one seat attaches to the lid.

The foregoing and other features, and advantages of the invention as well as embodiments thereof will become more apparent from the reading of the following description in connection with the accompanying drawings.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
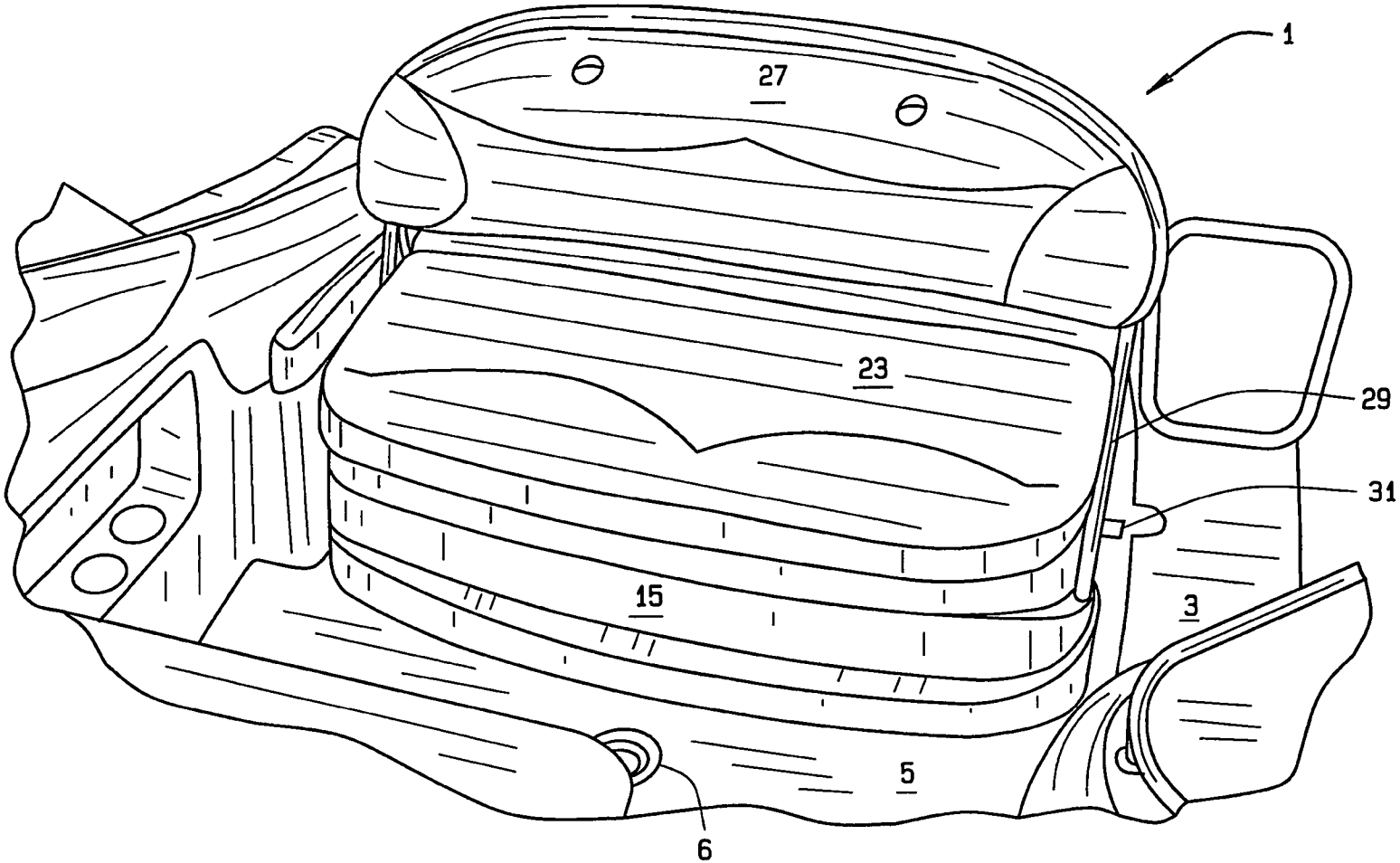
FIG. 1 is a perspective view of a boat with a hatch assembly accordance with and embodying the present invention.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

As shown in FIGS. 1–6, a preferred embodiment of the present invention, referred to generally as hatch assembly 1, includes a base 5 pivotally attached to a boat deck 3 with hinges 7 to provide access to an inboard motor mounted within the boat hull at the stern of the boat. As shown in FIG. 5, the base 5 is generally rectangular shaped to correspond with the shape of an opening 8 defined by the deck 3. A recessed edge 9 along the opening 8 seats with the base 5 and defines a channel 6 that works as a drip rail to prevent water from dripping into the hull. Recessed edge 9 collects water and routes or directs water away from the opening. The rear portion of the base 5 includes a step up section 10 (FIG. 5D), which corresponds to a step up area in the boat deck 3. The base 5 includes a storage bin 15 positioned on the top surface of the base 5, the bin 15 defining a compartment C for secure storage.

An electric lift 13 is operatively connected between the base 5 and a power source 11, such as an inboard motor or a battery. In operation, the electric lift 13 extends and retracts to pivot the base 5 between an open and closed position. In the open position, the electric lift 13 extends, thereby pivoting the hatch assembly 1 upwards and providing access to the power source 11 within the boat hull. In the closed position, the electric lift retracts, thereby, pivoting the hatch assembly downwards seating the base 5 on the recessed edge 9 so that the base 5 is flush with the deck 3. For ease of use, the electric lift 13 is also operatively connected to a switch on an instrument panel to allow the operator to remotely open and close the hatch 1. In addition, the lift 13 can be powered independently of the power source 11. Those skilled in the art will recognize that other types of lifts can be used, such as a hydraulic lift, a jack-type lift, or telescoping lift which may function manually and not connected to a power source. In any event, the term lift, particularly in the appended claims, is intended to include any apparatus that functions to raise and lower the hatch assembly 1.

Figure 7:
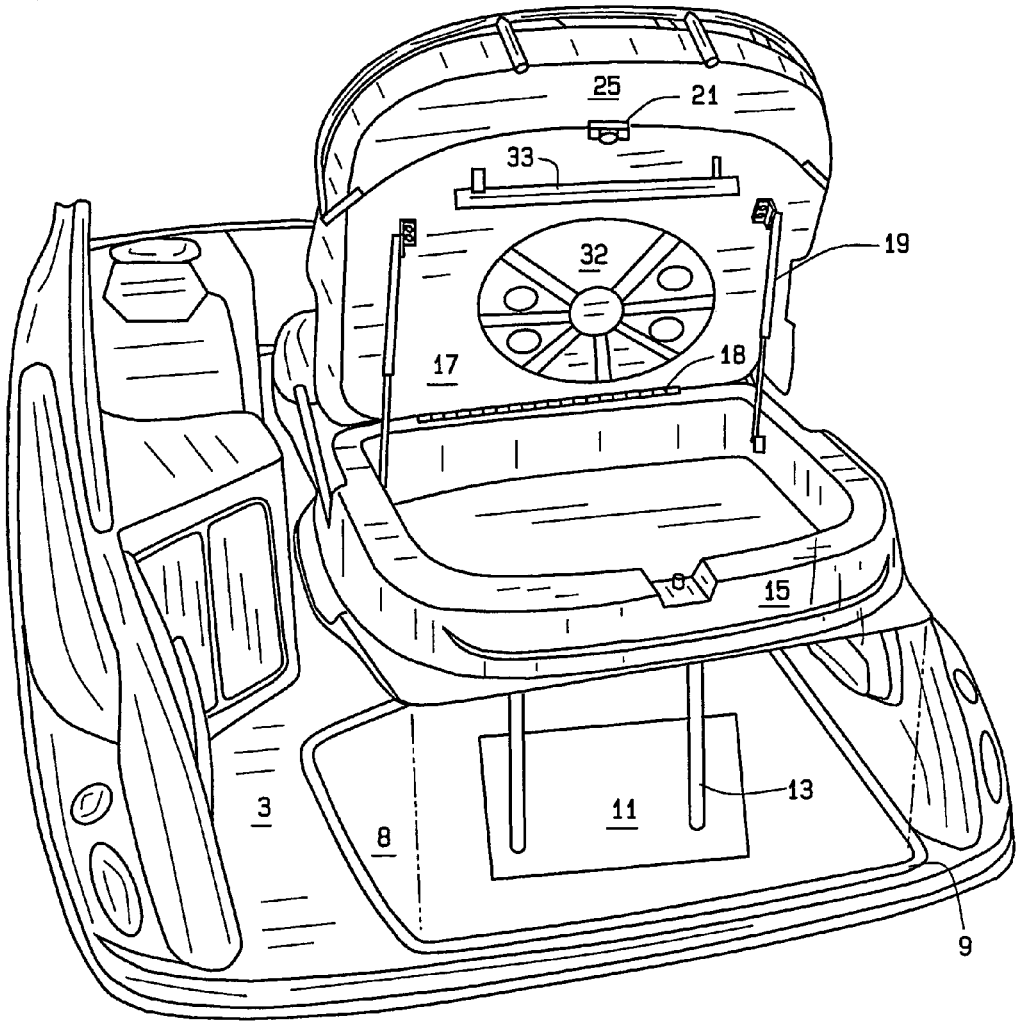
FIG. 7 is a perspective view of an alternate embodiment of a boat with a hatch assembly in accordance with and embodying the present invention.

While the preferred embodiment discloses the base 5 as pivotally attached to the boat deck 3 with hinges 7, alternate embodiments can include other methods of attaching the base 5 to the deck 3. In one alternate embodiment shown in FIG. 7, the base 5 can be removably attached to the deck 3. In this alternate embodiment, the base 5 seats in the recessed edge 9 of the deck opening 8 and can be raised and lowered, either manually or with an appropriate lift 13, from an open position to a closed position.

A lid 17 is pivotally attached to the storage bin 15 with hinge 18. Hydraulic struts 19 operatively connect the lid 17 with the storage bin 15 so that the lid pivots between an open position and a closed position. In the open position, the struts 19 extend, thereby pivoting the lid 17 upwards and providing access to the storage bin 15. The struts 19 are biased to hold the lid 17 in an open position. In the closed position, the struts retract, thereby pivoting the lid 17 downwards seating the lid 17 on the storage bin 15. For security purposes, the lid 17 includes a latch 21 to secure the lid 17 to the storage bin 15. While the illustrated embodiment shows hydraulic struts 19, it is understood that any other apparatus that can be employed to connect the lid with the storage bin so that the lid pivots between an open and closed position is encompassed by the scope of the invention. These apparatus could include, but are not limited to, hinge assemblies, a power actuated lift, a telescoping rod, and so forth. Hence, the term strut is intended to include any such apparatus that can perform the intended function.

While the preferred embodiment discloses the lid 17 as pivotally attached to the storage bin 15 with hinge 18, alternate embodiments can include other methods of attaching the lid 17 to the storage bin 15. For example, the lid 17 can be removably attached to the storage bin 15.

A front seat 23 and rear seat 25 are mounted to an outer surface of the lid 17 for passenger seating. The base 5 provides structural support to both seats 23 and 25 to handle the weight of the passengers. If desired, the lid 17 can be reinforced to support the weight of the passengers independently of the base. While the present embodiment discloses two seats 23 and 25 mounted to the lid 17, those skilled in the art will recognize that any number of seats can be used, including one or more.

Figure 2:
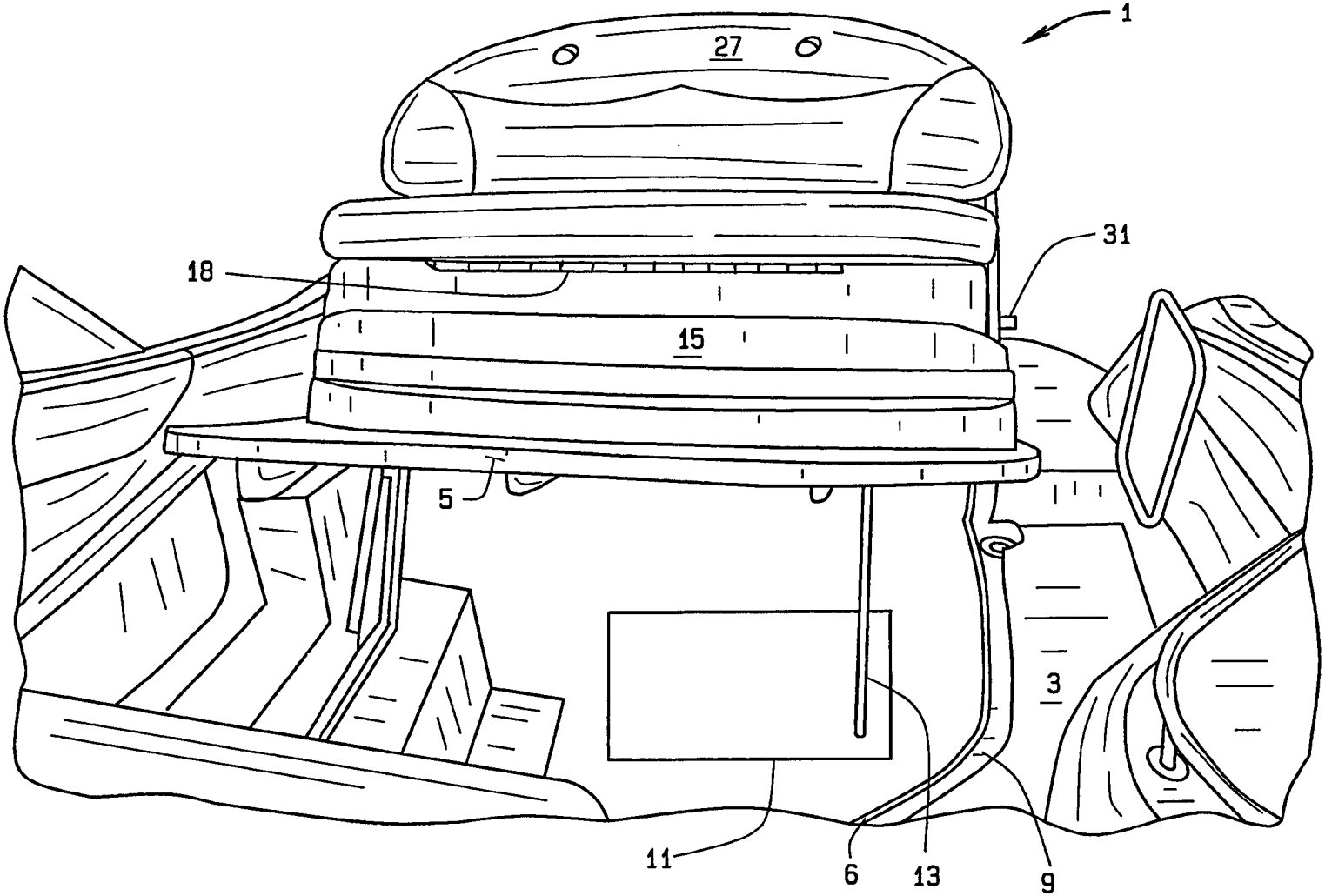
FIG. 2 is a perspective view of the boat with hatch assembly with the hatch assembly in an open position.
Figure 3:
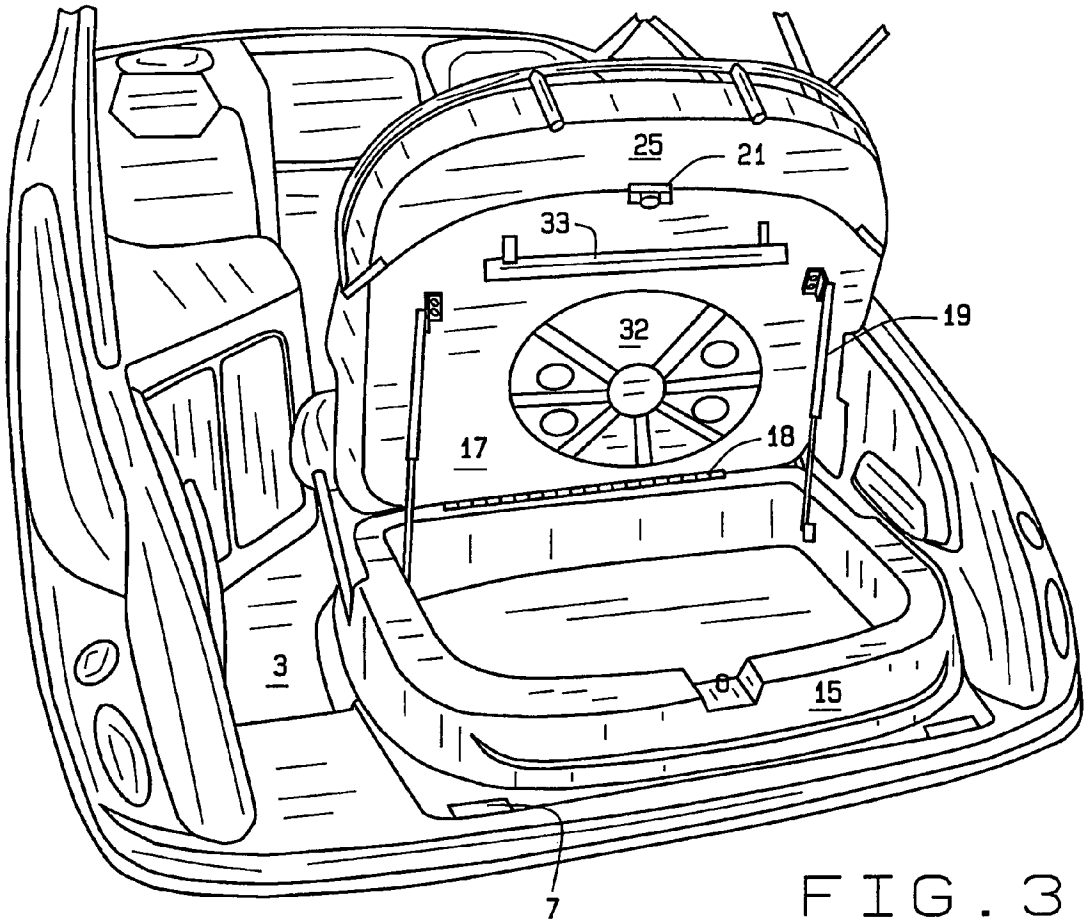
FIG. 3 is a perspective view of the boat with hatch assembly with the storage bin in an open position.
Figure 4:
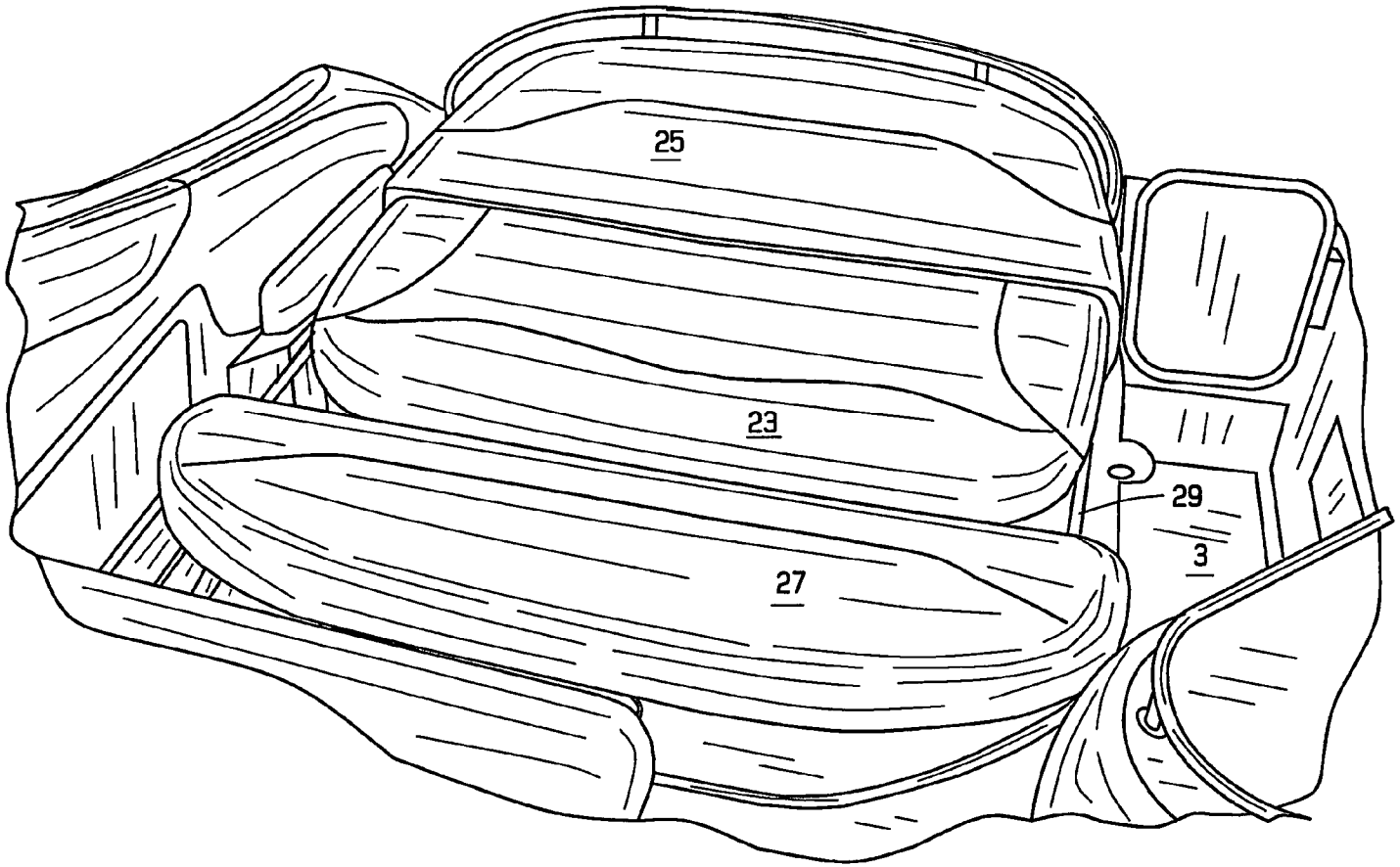
FIG. 4 is a perspective view of the boat with hatch assembly with the backrest in the reclining position.
Figure 5A:
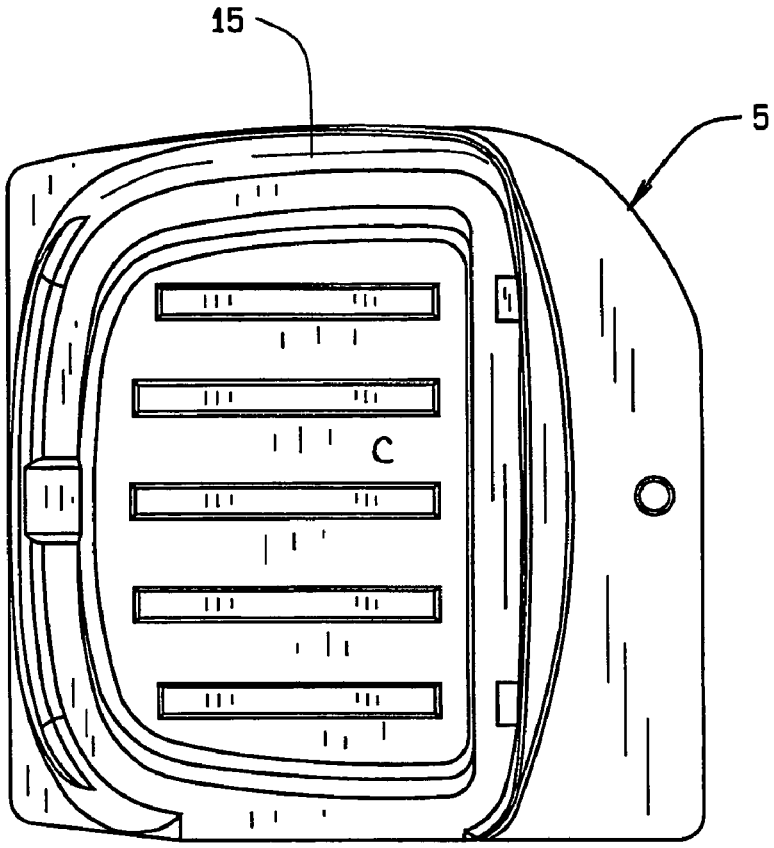
FIG. 5A is a top view of a base.
Figure 5B:
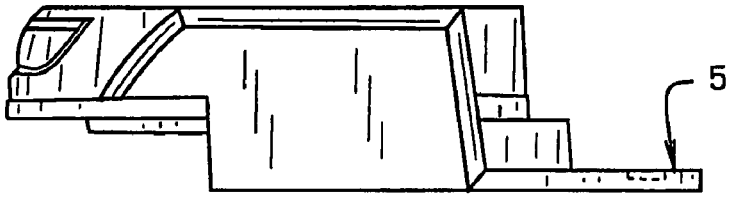
FIG. 5B is a side view of the base.
Figure 5C:
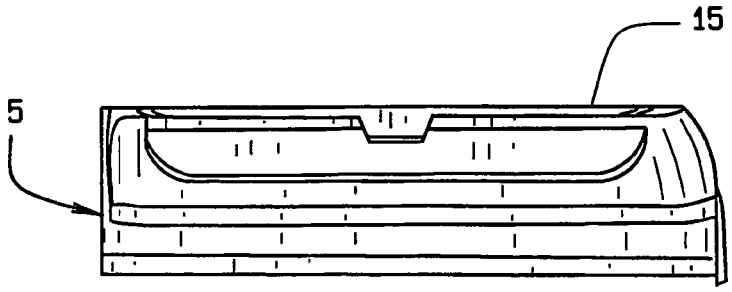
FIG. 5C is a rear view of the base.
Figure 5D:
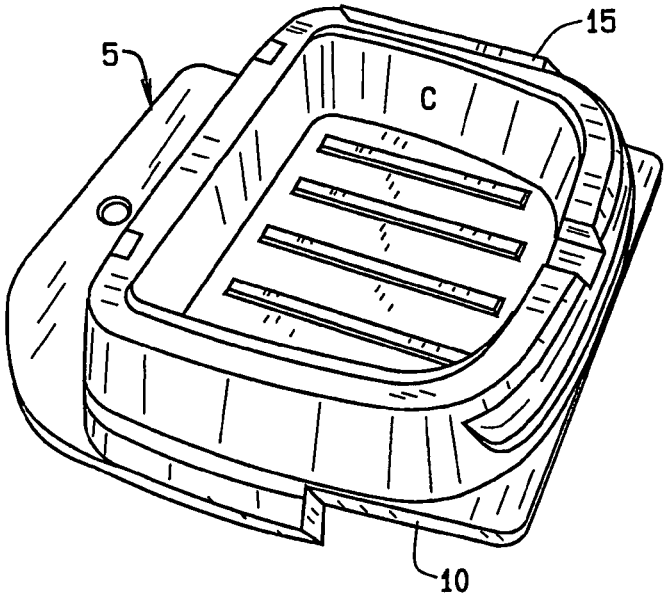
FIG. 5D is a perspective view of the base.
Figure 6:
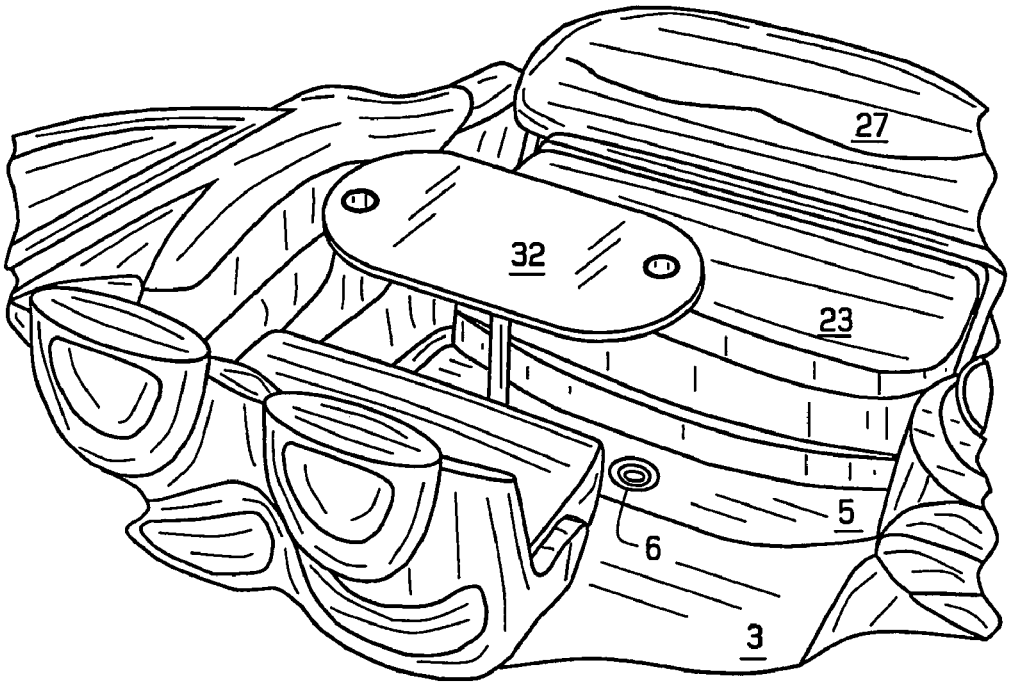
FIG. 6 is a perspective view of the boat with hatch assembly with a table and pedestal installed in the deck.

As best seen in FIGS. 1 and 2, for additional comfort, a padded backrest 27 is pivotally attached to the base 5 by supports 29. The backrest 27 pivots between a sitting position and a reclining position. In the sitting position illustrated in FIG. 1, the backrest 27 is vertically positioned above and juxtaposed between the seats 23 and 25, thereby creating a comfortable backrest for both seat 23 and 25. In the reclining position illustrated in FIG. 4, the backrest 27 is horizontally positioned in front of and parallel with the seats 23 and 25. In this position, the backrest 27 acts as an extension of the seats 23 and 25, thereby providing a large flat padded area that can be used for reclining or as a sun deck. The backrest 27 is secured in each one of these positions with any suitable means, such as a pin 31.

While the preferred embodiment discloses the backrest 27 as pivotally attached to the base 5 with supports 29, alternate embodiments can include other methods of attaching the backrest 27 to the base 5. For example, the backrest 27 can be removably attached to the base 5.

As an added feature, a table 32 and a pedestal 33 removably attached to an inner surface of the lid 17. The table 32 and pedestal can be removed to be assembled and installed in the boat deck 3 or the base 5. Those skilled in the art will recognize that other accessories can be removably attached to the lid 17, such as fenders, shore power, a light pole, a boat hook or other miscellaneous equipment used in boating.

Changes can be made in the above constructions without departing from the scope of the invention, it is intended that all matter contained in the above description or shown in the accompanying drawings shall be interpreted as illustrative and not in a limiting sense.

What is claimed is:

1. A boat comprising:

a deck;

a hatch assembly on the deck, the hatch assembly comprising;

a base pivotally attached to a boat deck, whereby the base can pivot between an open position and closed position to provide access to a boat hull, wherein the base defines a storage bin;

a lid pivotally attached to the base, whereby the lid can pivot between an open position and a closed position to provide access to the storage bin; and at least one seat attached to the lid.

2. The boat of claim 1, wherein the hatch assembly further comprises a lift operatively connected between a power source and the base, whereby the lift pivots the hatch assembly between an open position and closed position.

3. The boat of claim 1, wherein the hatch assembly further comprises a backrest pivotally connected to the base by at least one support, whereby the back rest pivots between a sitting position and a reclining position.

4. The boat of claim 1, wherein the hatch assembly further comprises a latch operatively connected between the lid and the base for securing the lid.

5. The boat of claim 1, wherein the hatch assembly further comprises at least one strut pivotally connected between the base and the lid.

6. The boat of claim 1, wherein the hatch assembly further comprises:

an accessory removably attached to the lid.

7. The boat of claim 6, wherein the accessory is a table capable of mounting to the boat deck.

8. The boat of claim 1, wherein the base seats on a recessed edge of the deck.

9. The boat of claim 8, wherein the recessed edge of the deck collects and diverts water.

10. A hatch assembly for a boat, comprising:

a storage means pivotally attached to a boat deck, whereby the storage means pivots between an open position and closed position to provide access to the boat hull; and a seating means pivotally attached to the storage means, whereby the seating means pivots from an open position to a closed position to provide access to the storage means.

11. The hatch assembly of claim 10, wherein the storage means comprises:

a base pivotally attached to a boat deck whereby the base pivots between an open position and closed position to provide access to the boat hull, wherein the base defines a storage bin.

12. The hatch assembly of claim 10, wherein the seating means comprises:

a lid pivotally attached to the base, whereby the lid pivots from an open position to a closed position to provide access to the storage means; and a seat attached to the lid and supported by the storage means.

13. The hatch assembly of claim 11, wherein the storage means further comprises a lift operatively connected to the base, whereby the lift pivots the hatch assembly between an open position and closed position.

14. The hatch assembly of claim 12, wherein the seating means further comprises a latch operatively connected between the lid and the storage means for securing the lid.

15. The hatch assembly of claim 10, further comprising a back rest pivotally connected to the storage means by at least one support, whereby the back rest pivots between a sitting position and a reclining position.

16. A hatch assembly for a boat deck, comprising:

a base removably attached to the boat deck, whereby the base can move between an open position and closed position to provide access to a boat hull, wherein the base defines a storage bin;

a lid removably attached to the base, whereby the lid can move between an open position and a closed position to provide access to the storage bin;

at least one seat attached to the lid; and a lift operatively connected to the base, whereby the lift moves the hatch assembly between an open position and closed position.

17. The hatch assembly of claim 16, further comprising a backrest removably attached to the base, whereby the backrest moves between a sitting position and a reclining position.

18. The hatch assembly of claim 16, further comprising a latch operatively connected between the lid and the base for securing the lid.

19. The hatch assembly of claim 16, further comprising at least one strut pivotally connected between the base and the lid.

20. The hatch assembly of claim 16, further comprising;

an accessory removably attached to the lid.

21. The hatch assembly of claim 16, wherein the accessory is a table.

22. The hatch assembly of claim 16, wherein the base seats on a recessed edge of the deck.

23. The hatch assembly of claim 22, wherein the recessed edge of the deck collects and diverts water away from the hatch assembly.

24. A hatch assembly for a boat, comprising:

a base pivotally attached to a boat deck, whereby the base can pivot between an open position and closed position to provide access to a boat hull, wherein the base defines a storage bin;

a lid pivotally attached to the base, whereby the lid can pivot between an open position and a closed position to provide access to the storage bin; and at least one seat attached to the lid.

25. The hatch assembly of claim 24, further comprising a lift operatively connected between to the base, whereby the lift pivots the hatch assembly between an open position and closed position.

26. The hatch assembly of claim 24, further comprising a back rest pivotally connected to the base by at least one support, whereby the back rest pivots between a sitting position and a reclining position.

* * * * *